US008613357B2

(12) United States Patent
Putnam

(10) Patent No.: US 8,613,357 B2
(45) Date of Patent: Dec. 24, 2013

(54) RECLOSABLE UPSIDE DOWN BEAM BLADE WIPER BLADE PACKAGE

(75) Inventor: Kevin Putnam, Pardeeville, WI (US)

(73) Assignee: Portage Plastics Corporation, Portage, WI (US)

( * ) Notice: Subject to any disclaimer, the term of this patent is extended or adjusted under 35 U.S.C. 154(b) by 217 days.

(21) Appl. No.: 13/283,572

(22) Filed: Oct. 27, 2011

(65) Prior Publication Data

US 2012/0103852 A1 May 3, 2012

Related U.S. Application Data

(60) Provisional application No. 61/407,442, filed on Oct. 27, 2010.

(51) Int. Cl.
*B65D 85/08* (2006.01)

(52) U.S. Cl.
USPC ..... 206/335; 206/448; 206/470

(58) Field of Classification Search
USPC ..... 206/335, 448, 467, 470, 471, 775, 776, 206/781, 782, 486
See application file for complete search history.

(56) References Cited

U.S. PATENT DOCUMENTS

| | | | | |
|---|---|---|---|---|
| 4,854,450 | A | 8/1989 | Fisher | |
| 5,379,896 | A | 1/1995 | Snow et al. | |
| 5,540,324 | A | 7/1996 | Knapp | |
| 5,899,334 | A * | 5/1999 | Domerchie et al. | 206/470 |
| 6,070,723 | A | 6/2000 | Lewis | |
| D434,226 | S | 11/2000 | Strohmeier | |
| 6,168,020 | B1 | 1/2001 | Niedzwiedz | |
| 6,766,906 | B2 | 7/2004 | Charng | |
| 6,779,661 | B1 | 8/2004 | Kotlarski | |
| 7,258,233 | B2 | 8/2007 | Lee | |
| 7,337,900 | B2 | 3/2008 | Reiber et al. | |
| D573,457 | S | 7/2008 | Park | |
| 7,527,151 | B2 | 5/2009 | Park | |
| 7,690,509 | B2 | 4/2010 | Herring et al. | |
| 7,699,169 | B2 | 4/2010 | Lewis | |
| 7,841,470 | B2 | 11/2010 | Chin | |
| D632,557 | S | 2/2011 | Clamagirand et al. | |
| 7,926,659 | B2 * | 4/2011 | Kim | 206/471 |
| 7,975,849 | B2 * | 7/2011 | Kim | 206/470 |
| 8,042,690 | B2 | 10/2011 | Lewis | |
| 8,434,621 | B2 * | 5/2013 | Hun et al. | 206/471 |
| 2003/0062284 | A1 | 4/2003 | Charng | |
| 2005/0252812 | A1 | 11/2005 | Lewis | |
| 2006/0081493 | A1 | 4/2006 | Park | |
| 2007/0017842 | A1 | 1/2007 | Clamagirand et al. | |
| 2007/0235362 | A1 | 10/2007 | Lewis | |
| 2007/0272577 | A1 | 11/2007 | Kim | |
| 2012/0111858 | A1 * | 5/2012 | Lewis | 220/4.23 |
| 2012/0199598 | A1 * | 8/2012 | Lewis | 220/780 |

* cited by examiner

*Primary Examiner* — Jacob K Ackun
(74) *Attorney, Agent, or Firm* — Boyle Fredrickson, S.C.

(57) ABSTRACT

A reclosable wiper blade package for holding a beam-type wiper blade in a substantially straightened condition in an upside down orientation with the wiping element of the blade facing upwardly toward a cover of the package. The package includes a blade-retaining package panel with a cavity formed therein having an adapter seat and blade engagement regions that engage corresponding arms of the wiper blade. Each blade engagement region is configured for snap fit engagement with an end portion of the wiper blade arm such as an end cap of the wiper blade.

15 Claims, 7 Drawing Sheets

RECLOSABLE UPSIDE DOWN BEAM BLADE WIPER BLADE PACKAGE

CROSS REFERENCE

This application claims priority under 35 U.S.C. §119(e) to U.S. Provisional Patent Application No. 61/407,442, filed Oct. 27, 2010, the entirety of which is hereby incorporated by reference herein.

FIELD

The present invention relates generally to packages and more particularly to a reclosable wiper blade package for packaging pre-curved beam type wiper blades.

BACKGROUND

Pre-curved beam-type windshield or windscreen wiper blades continue to grow in popularity throughout the United States and the world. Beam-type wiper blades have an elongate beam, typically made of a relatively thin generally rectangular strip of metal, which is substantially continuously curved during manufacture to impart a corresponding substantially continuous curve to an elastomeric, e.g., rubber, wiping element extending outwardly from the beam. Imparting such a substantially continuous curve to the wiping element causes the wiping element to make more uniform contact with a vehicle windshield or windscreen during wiper operation improving the squeegee action of the wiper blade.

Numerous challenges have been encountered in making packages that hold pre-curved beam-type wiper blades. One challenge resulted from the pre-curve of beam-type wiper blades having a greater transverse width than previous conventional articulating framework wiper blades. To minimize package volume and maximize retail display package density, thermoformed reclosable packages have been produced that hold pre-curved beam-type wiper blades in a partially or substantially straightened condition. These packages have a cover attached by a hinge to a blade-engaging base panel that has a blade-holding cavity formed therein configured to receive a beam-type wiper blade in an "upside-up" orientation with its adapter disposed adjacent the cover and its wiping element received in the cavity facing away from the cover.

Another challenge relates to protecting the wiping element while in the package. Due to the curvature of the beam and the relatively fragile nature of the rubber wiping element, the wiping element can become warped or distorted if it comes into contact with the package and takes on a set. When this happens, the outer tip or squeegee edge of the wiping element may be unable to make substantially continuous contact with a vehicle windshield when the wiper blade is installed, causing streaking to occur during operation. Should this occur with a brand new beam-type wiper blade taken right out of the package, customer expectations are not met which can also adversely affect future wiper blade purchasing decisions.

While "upside-up" reclosable wiper blade packages have enjoyed substantial commercial success, improvements nonetheless remain desirable. For example, achieving the desired draw ratio of the blade-holding cavity can be a challenge, particularly with narrower beam-type wiper blades. Even where the desired draw ratio can be achieved, it can still be desirable to provide greater clearance between the wiping element and the package to help prevent contact therebetween.

What is needed is an improved reclosable wiper blade package that better protects the wiping element of a beam-type wiper blade by providing greater clearance between the wiping element and the package. What is also needed is a reclosable wiper blade package that is particularly well suited for narrower beam-type wiper blades requiring a thermoforming draw ratio greater than can be achieved using current thermoforming equipment and methods.

SUMMARY

The present invention is directed to a reclosable wiper blade package configured to releasably hold a wiper blade in an upside down orientation with a wiping element of the wiper blade oriented upwardly toward a cover of the package when the package is closed. The cover of the package is joined by a hinge to a blade-retaining package panel that has a blade-holding cavity formed therein that is configured to releasably retain the wiper blade in an upside down orientation.

The wiper blade is a beam-type wiper blade having a pre-curved elongate beam that carries the elongate wiping element. The blade can include an elongate airfoil that extends outwardly from the beam in a direction generally opposite the wiping element. The blade has a pair of end caps attached to opposite free ends of the blade. Each end cap can be and typically is wider than the beam and can be and typically is wider than an adjacent portion of the airfoil over which the end cap fits. The blade includes an adapter carried by the beam dividing the blade into a pair of oppositely extending generally aligned wiper blade arms.

The blade-holding cavity is elongate having a pair of spaced apart blade-engagement regions spaced from an intermediately located blade adapter seat. Each blade engagement region is configured to releasably engage part of the wiper blade arm disposed at or adjacent the free end of the blade arm. When the blade is inserted into the cavity, each blade arm engages a corresponding blade-engagement region with the wiper blade adapter seated in the adapter seat.

The cavity includes a pair of blade-arm receiving channels extending outwardly in opposite directions from the blade adapter seat. A pair of sidewalls and a bottom wall defines each channel. A blade engagement region extends inwardly from each channel sidewall adjacent or along a mouth of the channel providing an interference or snap fit with a corresponding end of a wiper blade arm received in the channel when the wiper blade is inserted into the cavity.

Each blade engagement region includes opposed blade-arm retention fingers extending inwardly from opposite channel sidewalls. In one embodiment, the blade engagement region of each channel includes a plurality of opposed retention fingers spaced apart along the channel sidewalls. In one embodiment, the retention fingers are staggered and configured to engage an end cap of a beam-type wiper blade inserted into the cavity. In one embodiment, a pair of opposed retention fingers engage an end cap of a blade arm received in each channel. In another embodiment, at least one retention finger of one channel sidewall engages one side of the end cap and a plurality of retention fingers of the opposite channel sidewall engages an opposite side of the end cap.

The cover has an outer wall that is spaced away from the wiping element when the wiper blade is inserted into the cavity and the package is closed providing clearance therebetween that protects the wiping element. The cover can include an integrally formed chamber that spaces the outer wall from the wiping element protecting the wiping element and providing clearance therebetween. In one embodiment, the wiping element extends upwardly and outwardly beyond an upper or outer surface of the blade-retaining package panel thereby providing clearance between the wiping element and any part of the blade-retaining package panel.

In use, a beam-type wiper blade is maneuvered so its wiping element faces outwardly or upwardly during insertion of the blade into the package cavity. Each blade arm is inserted with its airfoil disposed toward and adjacent the end wall of the corresponding blade arm receiving channel that receives the blade arm. Each blade arm is snapped into its corresponding blade arm-receiving channel with the end cap of each blade arm engaging retention fingers of the corresponding blade engagement region. When both blade arms are snapped into their corresponding blade arm receiving channel, spring back due to the pre-curved beam of the wiper blade causes the adapter of the wiper blade to seat in the adapter seat of the cavity.

The package is closed by engaging the cover with the blade-retaining package panel enclosing the wiper blade received in the cavity. By orienting the wiper blade upside down with the wiping element clearing the blade-retaining package panel and facing toward the cover, no part of the wiping element comes into contact with any part of the package. Such a package construction is particularly well suited for narrower beam-type wiper blades that would ordinarily require a blade-receiving cavity of greater draw ratio.

These and various other features, aspects, and advantages of the present invention will be made apparent from the following descriptions of the drawings and detailed description.

DRAWING DESCRIPTION

The drawings illustrate at least one preferred embodiment presently contemplated for carrying out the invention. In the drawings.

Figure 1:
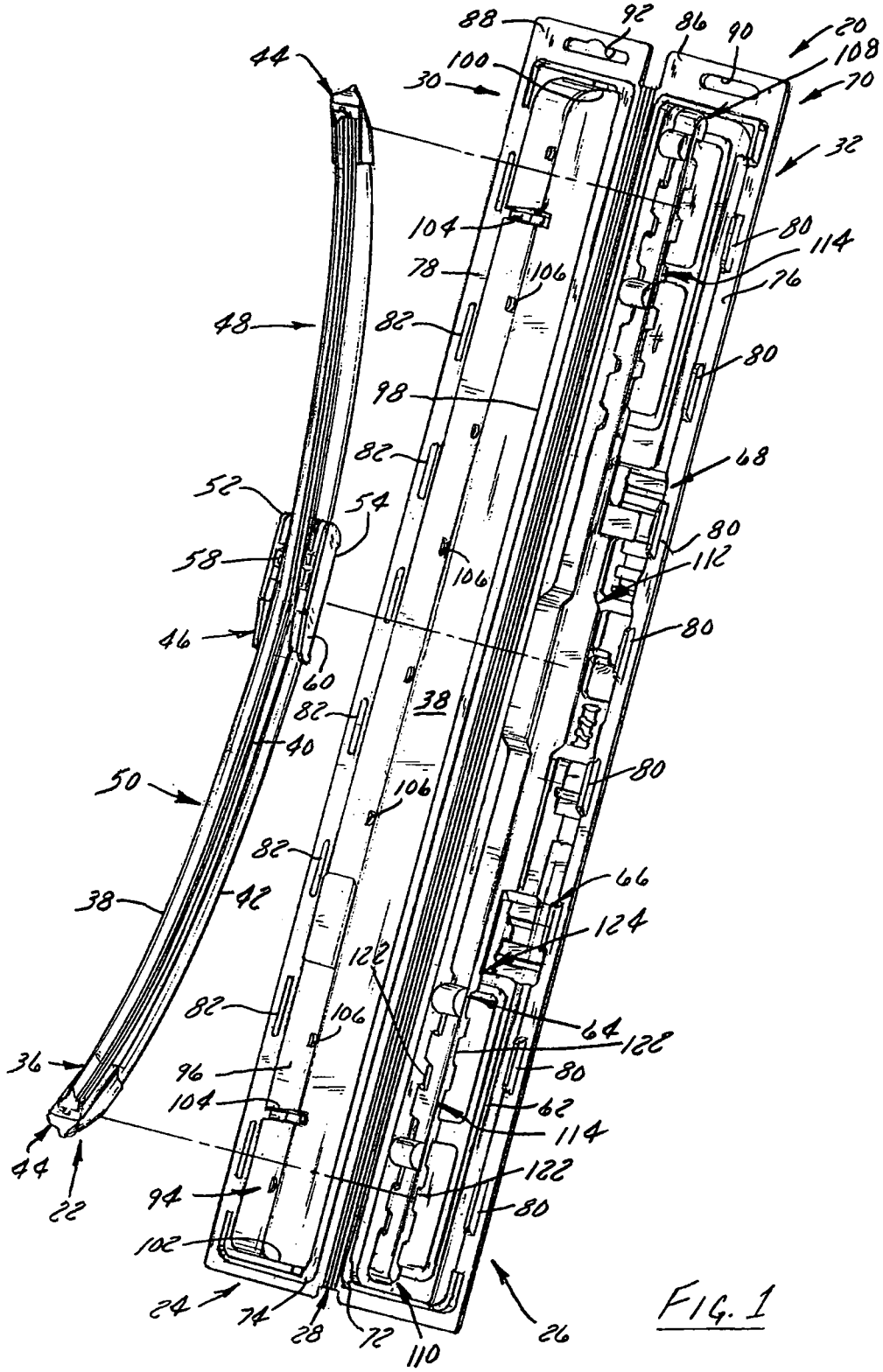
FIG. 1 is a perspective exploded view of a pre-curved beam-type wiper blade and reclosable package for holding the wiper blade constructed in accordance with the present invention.

Before explaining one or more embodiments of the invention in detail, it is to be understood that the invention is not limited in its application to the details of construction and the arrangement of the components set forth in the following description or illustrated in the drawings. The invention is capable of other embodiments, which can be practiced or carried out in various ways. Also, it is to be understood that the phraseology and terminology employed herein is for the purpose of description and should not be regarded as limiting.

DETAILED DESCRIPTION

FIGS. 1-9 illustrate a reclosable clamshell wiper blade package 20 constructed in accordance with the present invention that is configured for releasably holding an elongate pre-curved beam-type wiper blade 22 in a substantially straightened condition and that is capable of being shown in a retail display setting. The package 20 includes a pair of elongate package halves 24 and 26 joined by an elongate hinge 28 with one of the package halves 24 being a cover 30 that releasably engages and overlies a blade-retaining package panel 32 when closed. The blade-retaining package panel 32 has a recessed blade-holding cavity 34 three dimensionally formed therein that is configured to releasably retain the blade 22 in an upside down orientation with its wiping element 36 facing outwardly toward an outer wall 38 of the cover 20. Such an "upside down" package configuration advantageously provides greater clearance between any part of the package 20 and an elongate longitudinally extending squeegee tip 38 of the wiping element 36 of the blade 22 when the package 20 is closed (FIG. 7) better protecting the wiping element 36 while packaged.

The beam-type wiper blade 22 has an elongate pre-curved beam 40 of generally rectangular and relatively thin construction provides a spine or backbone for an elongate wiping element 36 that extends outwardly from the beam 40. The beam 40 can be made of metal, such as steel or the like, which is formed in a manner that imparts a pre-curve to the beam 40. The pre-curved beam 40 in turn imparts a curve to the wiping element 36, which is made of a flexible elastomeric material, such as a rubber or the like. The curve imparted by the wiping element 36 helps increase the surface area and uniformity of contact between the outer squeegee-functioning edge or tip 38 of the wiping element 36 and vehicle windshield during wiper blade operation. The blade 22 typically includes an elongate airfoil 42 that extends outwardly from the beam 40 in a direction opposite the wiping element 36. The airfoil 42 can be made of the same material as the wiping element 36 or can be made of a harder, less resilient material, such a plastic or the like. The airfoil 42 is aerodynamically configured to increase downforce on the wiping element 36 as the vehicle is driven that helps urge the squeegee tip 38 of the wiping element 36 into better contact with the vehicle windshield.

An end cap 44 having a width greater than the beam 40 is attached to each end of the blade 22 to help keep the wiping element 36 and airfoil 42 in place and attached to the beam 40. The end cap 44 can be made of a material that is harder and less resilient than the wiping element 36, such as a plastic or the like. The end cap 44 is configured to engage part of the blade 22, such as part of the wiping element 36, beam 40 and/or airfoil 42 such as via snap fit engagement or the like. Each end cap 44 encloses a corresponding end of the blade 22 and can have a cross-sectional contour substantially the same as that of the airfoil 42 but be larger than the airfoil 42 as part of the end cap 44 typically overlies and encloses part of the airfoil 42 at or adjacent the blade end.

The wiper blade 22 also includes an adapter 46 disposed in a cutout of the airfoil 42 that is used to releasably attach the blade 22 to a reciprocating wiper arm (not shown) of a vehicle. The adapter 46 can be located substantially halfway between the end caps 44 dividing the blade 22 into a pair of oppositely extending blade arms 48 and 50. The adapter 46 can be made of plastic and includes an adapter housing 52 that includes an end wall 54 that have a generally flat or planar portion 56 and a pair of sidewalls 58 and 60 that extend from the end wall 54 along a respective side of the wiper blade beam 40 bracketing the beam 40.

While the reclosable wiper blade package 20 constructed in accordance with the present invention is particularly well suited for use with relatively narrow beam-type wiper blades that would ordinarily require a relatively undesirably high wiper blade draw ratio, such as the wiper blade shown in the drawing figures, the package 20 can also be used with other beam-type wiper blade configurations. For example, examples of other suitable beam-type wiper blades are disclosed in U.S. Pat. Nos. 8,024,836; 7,716,780; 7,543,353; 7,523,519; 6,951,043; 6,944,905 and 6,836,926, the entire contents of each of which is expressly incorporated by reference herein.

The package 20 is thermally vacuum formed of a relatively thin sheet of vacuum formable material producing a package 20 that is substantially transparent enabling a prospective purchaser to view the contents of the package 20 when displayed in a retail setting, such as a store or the like. In a preferred embodiment, the package 20 is thermoformed of a single sheet of plastic, such as polyethylene terephthalate (PET), which can be recycled or reprocessed (RPET). Other plastics, such as polyvinyl chloride, polyethylene tetraglycol (PETG), a styrene, a K-resin, or the like can also be used to form a package 20 constructed in accordance with the present invention. Such a plastic sheet is relatively thin, having a thickness of between 0.0075 inches and 0.075 inches, with a typical thickness ranging between about 0.08 and about 0.070 inches, preferably on the order of about 0.010 inches, producing a package 20 having a corresponding thickness when thermoformed.

The blade-retaining package panel 32 can be generally rectangular and include a panel wall 62 that can be generally planar with a three dimensionally contoured, recessed and elongate blade-holding cavity 64 formed therein. The panel wall 62 can be formed to include a plurality of recessed wells 66 and 68 disposed alongside the blade-holding cavity 64 for holding additional wiper blade related components (not shown) including additional mounts or adapters for attaching the wiper blade 22 to different vehicle wiper arm configurations.

The blade-retaining package panel 32 includes one portion of a package closure arrangement 70 formed therein that releasably engages another portion of the package closure arrangement formed in the cover 30 to enable the package 20 to be repeatedly opened and closed. The package closure arrangement 70 includes an upraised elongate rib 72 formed in the package panel 32 that extends along the hinge 28 with sections of the rib 72 extending along the upper and lower portion of the panel 32. When the package 20 is closed, the rib 72 is releasably received in a recess 74, e.g., channel, formed in the cover 30 that extends along the hinge 28 with sections of the recess 74 extending along the upper and lower portion of the cover 30. If desired, the rib 72 of the package closure arrangement 70 can be formed in the cover 30 and the recess 74, e.g., channel, can be formed in the package panel 32.

Both the blade-retaining package panel 32 and the cover 30 can include a flange 76 and 78 bounding a respective periphery thereof in which the rib 72 and recess 74 of the package closure arrangement 70 are respectively formed. An outboard section of the flange 76 of the blade-retaining package panel 32 includes a plurality of elongate upraised male bars 80 spaced apart substantially the length of the package panel 32 that are each releasably received in and engage recessed female bar pockets 82 formed in an outboard section of the flange 78 of the cover 30 forming a plurality of bar snaps 84 that help releasably retain the package 20 in a closed condition, such as the closed package 20 depicted in FIGS. 7-9. Such ribs, channels and bar snaps help strengthen and structurally rigidify the package 20 when closed. If desired, the cover 30 can be equipped with male bars 80 and the blade-retaining package panel 32 can be equipped with female bar pockets 82. If desired, another type of package closure arrangement can be employed.

An upper section 86 and 88 of each flange 76 and 78 can include a hanger hole 90 and 92 that can be of elongate construction for receiving a hook, hanger, peg or the like of a retail display, display case of the like. While the hanger holes 90 and 92 shown in the drawing figures are elongate, they can be circular, oval, oblong, butterfly shaped or have a different shape or configuration.

The flange 78 of the cover 30 bounds a three dimensionally recessed generally rectangular chamber 94 that encloses a wiper blade 22 releasably received in the blade-holding cavity 64 of the package panel 32 when the package 20 is closed without contacting any part of the blade 22. The chamber 94 is defined by a pair of generally spaced apart and elongate sidewalls 96 and 98, a pair of spaced apart end walls 100 and 102, and an outer wall 38 that can be generally planar that is spaced above the tip 38 of the wiping element 36 of a wiper blade 22 received in the blade-holding cavity 64 of package panel 32 so as not to contact any part of the wiping element tip 38.

Figure 3:
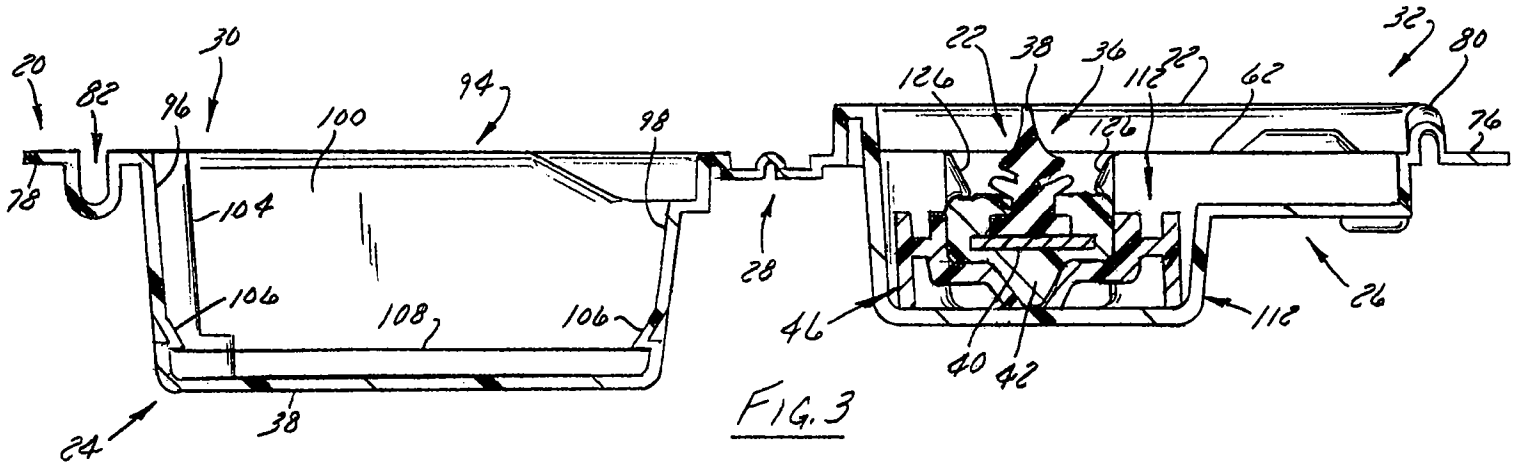
FIG. 3 is a cross-sectional view of the package taken through line 3-3 of FIG. 2 showing an adapter of the wiper blade disposed in an adapter-receiving seat of the of the wiper-blade holding cavity of the package.
Figure 4:
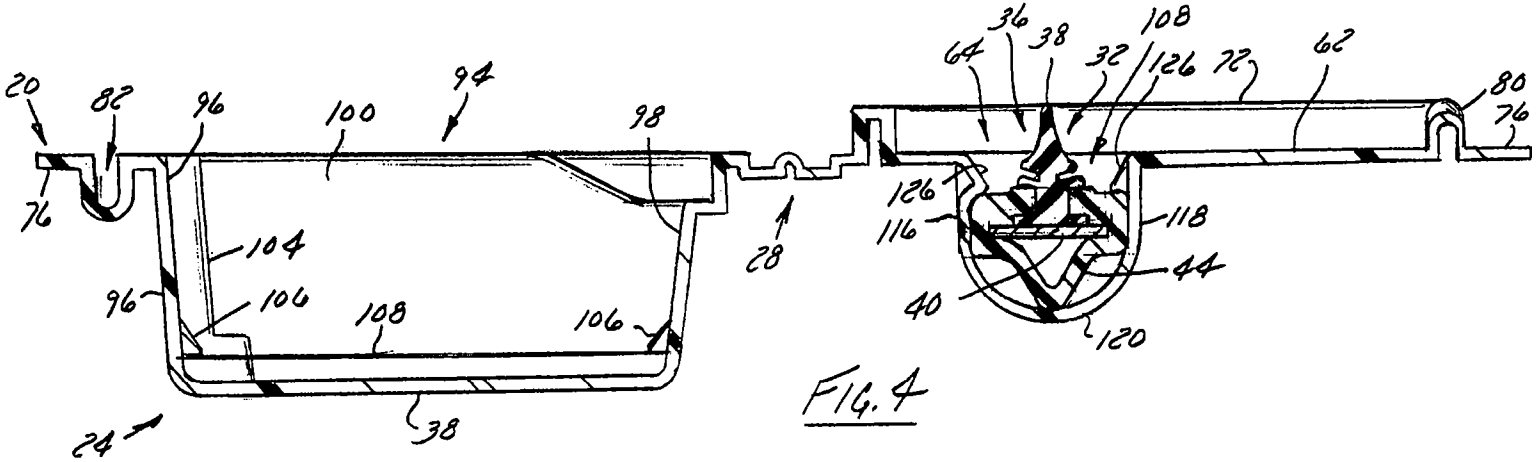
FIG. 4 is a cross-sectional view of the package taken through line 4-4 of FIG. 2 showing an arm of the wiper blade received in a channel of the wiper-blade holding cavity with an end cap of the wiper blade engaged by a plurality of opposed fingers that extend into the channel.

One or both chamber sidewalls 96 and 98 can include spaced apart and integrally formed stiffening ribs 104 that extend into the chamber 94 to help strengthen and structurally rigidify the cover 30. As is best shown in FIGS. 3 and 4, each sidewall 96 and 98 includes a plurality of spaced apart card holding ledges 106 that also extending to the chamber 94 that are spaced from the outer wall 38 of the cover to releasably capture a retail display card 108 therebetween. Such a retail display card 108 can include printed indicia related to the wiper blade 22, such as marketing information, make and model, assembly and operating instructions, and the like visible to a prospective purchaser looking at the card 108 through the transparent outer wall 38 of the cover 30.

The blade-holding cavity 64 is constructed and arranged to releasably retain a beam-type wiper blade 22 oriented in an upside down orientation with the wiping element 36 facing outwardly toward the outer wall 38 of the cover 30. Such a wiper blade orientation advantageously spaces the wiping element 36 from any adjacent portion of the blade-retaining package panel 32 and the cover 30 preventing the wiping element 36 from coming into contact with any portion of the package 20 when the package 20 is closed.

Figure 2:
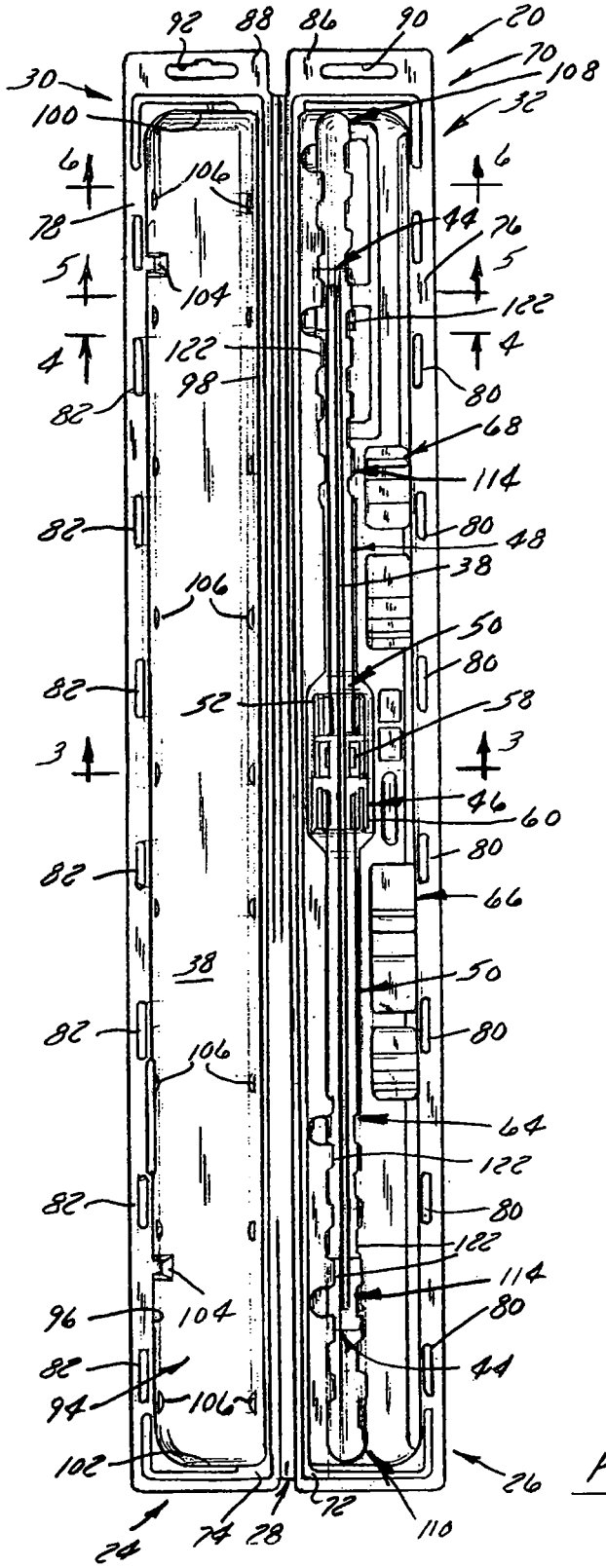
FIG. 2 is a top plan view of the wiper blade and package with the blade inserted into a wiper-blade holding cavity formed in a blade-holding package panel of the package.
Figure 7:
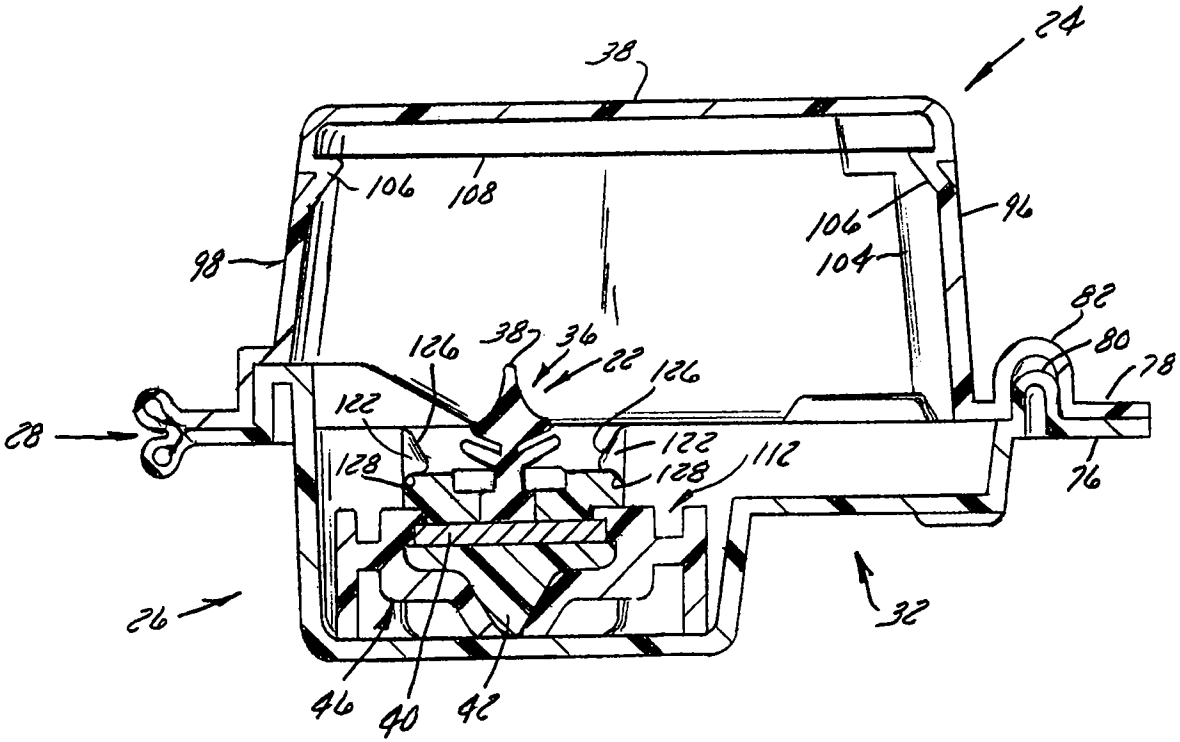
FIG. 7 is a cross sectional view of the package with the package closed illustrating the wiper blade inserted into the package in an upside down orientation with its wiping element extending outwardly facing toward a cover of the package.
Figure 8:
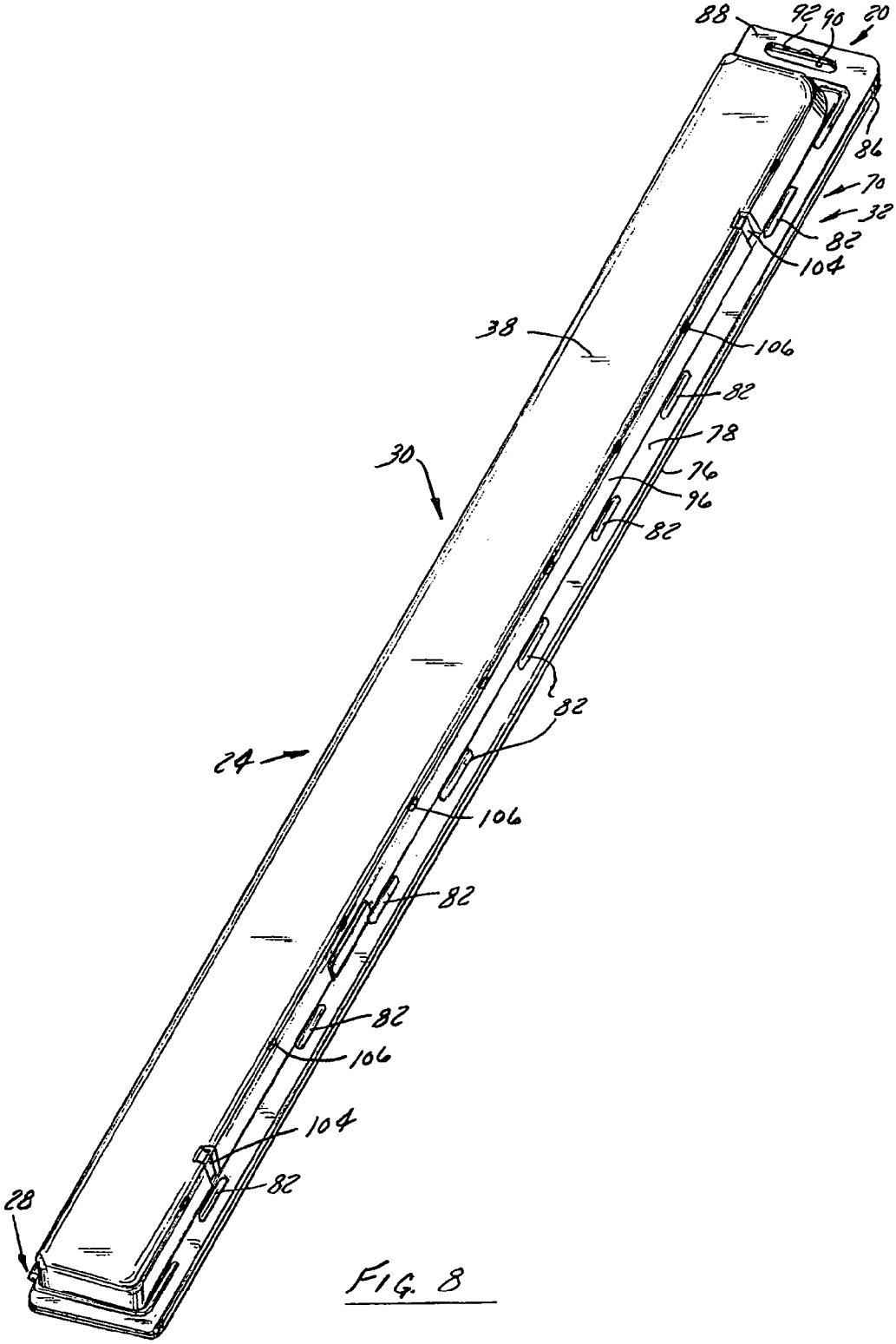
FIG. 8 is a top perspective view of the closed package.
Figure 9:
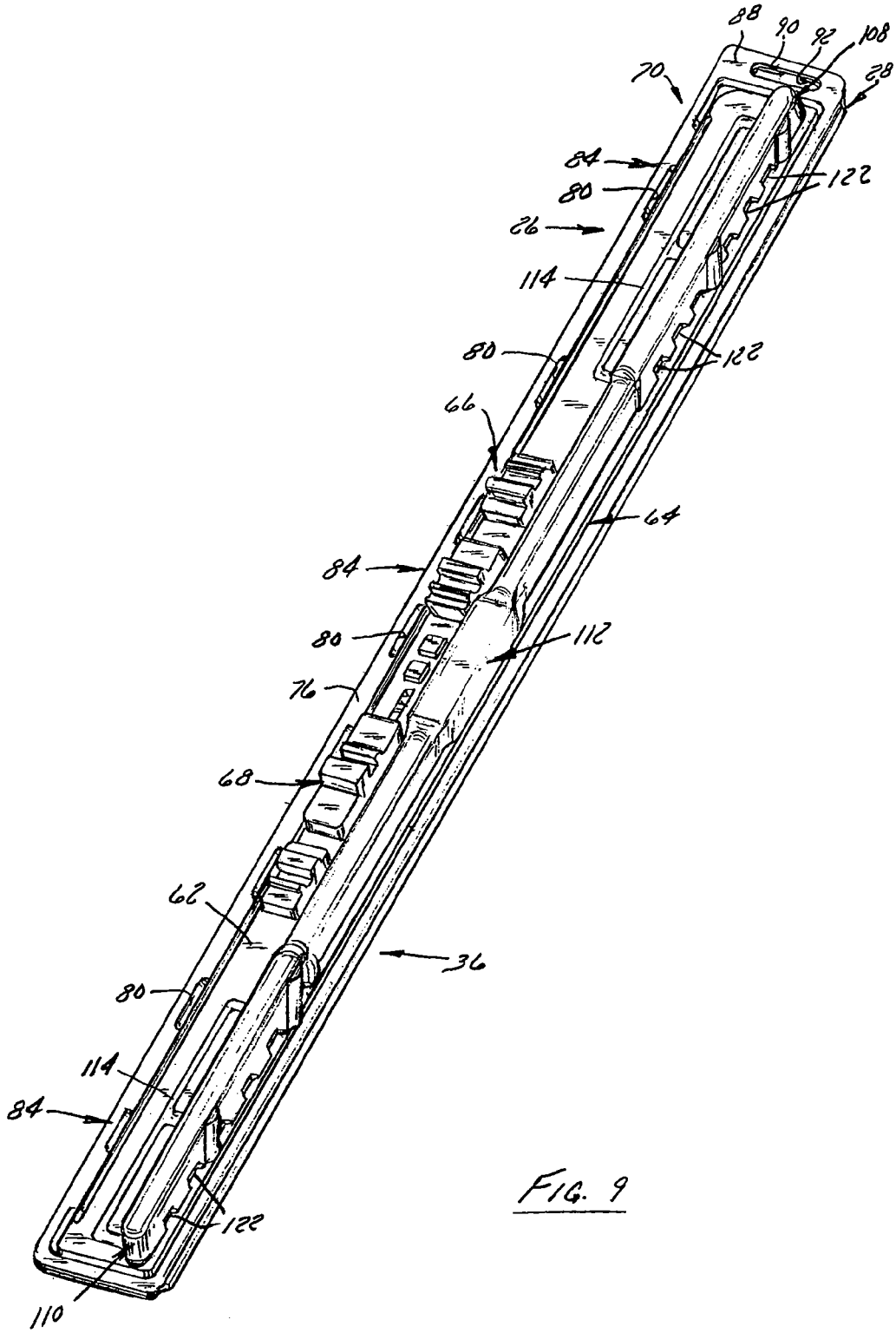
FIG. 9 is a bottom perspective view of the closed package.

The blade-holding cavity 64 is configured to releasably engage each one of the blade arms 48 and 50 when the wiper blade 22 is inserted into the cavity 64 in an upside down orientation in a substantially straightened condition, such as is depicted in FIG. 2. When the blade 22 is inserted into the cavity 64 in an upside down orientation with its wiping element 36 facing outwardly toward the cover 30, spring back caused by the pre-curved beam 40 of the blade 22 causes the adapter 46 to bear against a portion of the cavity 64, such as is depicted in FIG. 7, helping to positively secure the blade 22 in the cavity 64.

The blade-holding cavity 64 is elongate and defined by a pair of blade-arm receiving channels 108 and 110 that extend oppositely outwardly in opposite directions from wider adapter seat 112. Each blade-arm receiving channel 108 and 110 is elongate and narrower than the adapter seat 112 to help guide, locate and orient the wiper blade 22 during insertion of the blade 22 into the cavity 64. With reference to FIG. 2, each blade-arm receiving channel 108 and 110 includes a narrower elongate blade-arm engagement region 114 spaced from the adapter seat 112 so as to engage a corresponding blade arm 48 and 50 along part of the arm 48 and 50 located at or adjacent the free end of the arm 48 and 50. Such blade-arm end engagement advantageously takes advantage of the inherent spring back of the pre-curved beam 40 of the blade 22 to urge the adapter 46 firmly against the adapter seat 112 positively securing the blade 22 in the cavity 64.

This results in at least three points of contact between the blade 22 and blade-retaining package panel 32 with each blade arm 48 and 50 being clamped at or adjacent each blade end by the blade-arm engagement region 114 and the adapter 46 being urged into and against the seat 112 by beam spring back. Spring back can also facilitate more positive engagement between blade-arm engagement region 114 of each blade-arm receiving channel 108 and 110 with a corresponding portion of the blade arm 48 and 50 received in the channel 108 and 110.

Each blade-arm engagement region 114 is elongate to enable the package 20 to hold a plurality of sizes of beam-type wiper blades 22. For example, in one preferred package embodiment, the length of the blade-holding cavity 64 and the length of each blade-arm engagement region 114 is selected to enable the package 20 to hold beam-type wiper blades 22 having lengths between twenty four inches and twenty eight inches. In another preferred package embodiment, the length of the cavity 64 and each blade-arm engagement region 114 is selected to hold wiper blades 22 having lengths between about eighteen inches and about twenty two inches. A package 20 constructed in accordance with the present invention can have its cavity 64 and blade-arm engagement region 114 sized to accommodate wiper blades 22 of other and varying sizes and lengths.

Figure 6:
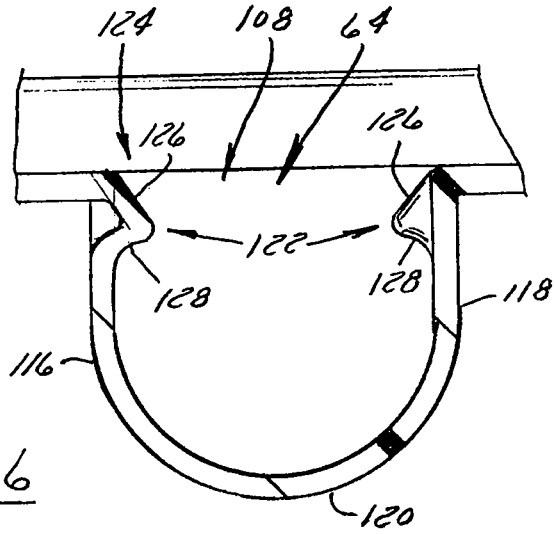
FIG. 6 is an enlarged partial fragmentary cross-sectional view of the package taken through line 6-6 of FIG. 2 showing the blade-arm receiving channel and end-cap engaging fingers in more detail.

Each blade arm receiving channel 108 and 110 is formed by a pair of elongate and generally parallel sidewalls 116 and 118 and a bottom wall 120 that extends between and interconnects the sidewalls 116 and 118. As is shown in FIG. 6, each blade-arm receiving channel 108 and 110 can be generally U-shaped with the bottom wall 120 configured to generally conform to the outer shape of the airfoil 42 when the blade 22 is received in the cavity 64.

In the preferred package embodiment shown in the drawing figures, each blade-arm engagement region 114 includes a pair of opposed retention fingers 122 that extend inwardly from a corresponding one of the channel sidewalls 116 and 118 into a respective channel 108 and 110. As is depicted in FIG. 6, each retention finger 122 can be generally V-shaped extending inwardly into a corresponding channel 108 and 110 along a mouth 124 of the channel 108 and 110 where the blade 22 is inserted during packaging. Each finger 122 has an inclined leading edge surface 126 that helps guide a corresponding blade arm 48 and 50 into the channel 108 and 110 during insertion. Each finger 122 also has a generally oppositely inclined abutment surface 128 that abuts against a portion of a corresponding blade arm 48 and 50 received in a respective one of the channels 108 and 110 such as in the manner depicted in FIGS. 4 and 5 to releasably retain the blade arm 48 and 50 in its channel 108 and 110. The inclined leading edge surface 126 of each finger 122 generally faces outwardly toward the mouth 124 of the channel 108 and 110 and generally faces at an angle toward the cover 30 when the package 20 is closed. The inclined abutment surface 126 of each finger 122 generally faces outwardly toward an opposite channel wall 116 and 118 and generally downwardly toward the channel bottom wall 120, such as depicted in FIG. 6.

Figure 5:
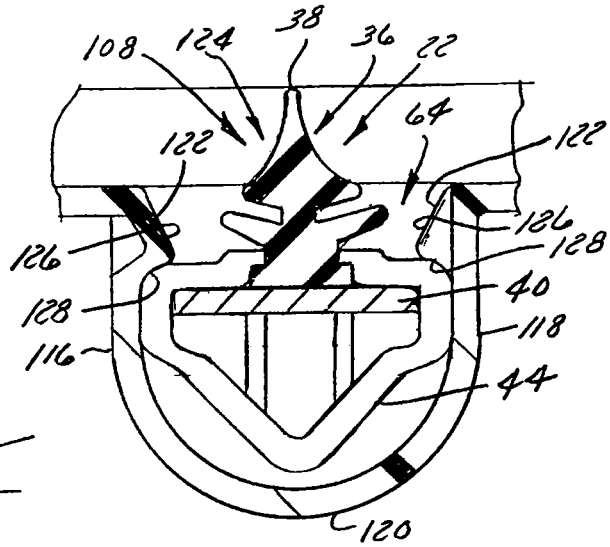
FIG. 5 is an enlarged partial fragmentary cross-sectional view of the package taken through line 5-5 of FIG. 2 showing the end cap of the wiper blade in engagement with a plurality of the opposed end-cap engaging fingers of the package.

As is shown in FIG. 5, when the blade 22 is inserted, an interference or snap fit provided between opposed retention fingers 122 causes engagement between an outer shoulder or bottom portion of the end cap 44 and the retention fingers 122. When the blade 22 is inserted, at least one retention finger 122 of each channel sidewall 116 and 118 engages against part of the end cap 44 with the abutment surface 126 bearing against the end cap 44. As is shown in FIG. 2, the blade engagement region As is shown in FIG. 5, when the blade 22 is inserted into the cavity 64, the.

When the cover 30 is closed, the cover outer wall 38 is spaced away from the wiping element 36 providing clearance therebetween that protects the wiping element. The cover can include an integrally formed chamber that spaces the outer wall from the wiping element protecting the wiping element and providing clearance therebetween. In one embodiment, the wiping element 36 extends upwardly and outwardly beyond an upper or outer surface 62 of the blade-retaining package panel 32 thereby providing clearance between the wiping element and any part of the blade-retaining package panel 32.

In use, the beam-type wiper blade 22 is maneuvered so its wiping element 36 faces outwardly or upwardly during insertion of the blade 22 into the package cavity 64. Each blade arm 48 and 50 is inserted with its airfoil 42 disposed toward and adjacent the end wall 120 of the corresponding blade arm receiving channel that receives the blade arm. Each blade arm 48 and 50 is snapped into its corresponding blade arm-receiving channel with the end cap 44 of each blade arm 48 and 50 engaging retention fingers 122 of the corresponding blade engagement region 114. When both blade arms 48 and 50 are snapped into their corresponding blade arm receiving channel, spring back due to the pre-curved beam 40 of the wiper blade 22 causes the adapter 46 of the blade to seat in the adapter seat 112 of the cavity 64.

The package 20 is closed by engaging the cover 30 with the blade-retaining package panel 32 enclosing the wiper blade 22 received in the cavity 64. By orienting the wiper blade 22 upside down with the wiping element 36 clearing the blade-retaining package panel 32 and facing toward the cover 30, no part of the wiping element 36 comes into contact with any part of the package 20. Such a package construction is particularly well suited for narrower beam-type wiper blades that would ordinarily require a blade-receiving cavity of greater draw ratio.

Understandably, the present invention has been described above in terms of the preferred embodiment. It is recognized that various alternatives and modifications may be made to the preferred embodiment and be within the scope of the appended claims.

What is claimed is:

1. A reclosable wiper blade package in combination with a wiper blade comprising:

a wiper blade having an elongate beam, a flexible wiping element carried by the beam, a pair of end caps attached at opposite ends of the beam, and an adapter attached to the beam between the end caps;

a reclosable wiper blade package comprised of a pair of package halves joined by a hinge with one of the package halves comprising a cover and the other one of the package halves comprising a blade-retaining package panel having a blade-holding cavity formed therein configured to hold the wiper blade and orient the flexible wiping element of the wiper blade facing toward the cover; and wherein the wiper blade is received in the blade-holding cavity with the wiping element facing toward the cover.

2. The package and wiper blade combination of claim 1 wherein the cavity is defined by an elongate channel configured to engage the end caps of the wiper blade when the wiper blade is received in the channel.

3. The package and wiper blade combination of claim 2 wherein the channel includes an adapter-receiving seat dividing the channel into oppositely outwardly extending narrower blade-arm receiving channel segments that are generally aligned with one another.

4. The package and wiper blade combination of claim 3 each blade-arm receiving channel segment is defined by a pair of spaced apart and generally parallel sidewalls that each have a wiper blade end cap engaging finger that extends outwardly from the sidewall into the channel segment that engages a corresponding one of the end caps of the wiper blade when the wiper blade is received in the channel.

5. The package and wiper blade combination of claim 4 wherein each blade-arm receiving channel segment has a generally U-shaped cross-section with a rounded end wall extending from one channel segment sidewall to the other channel segment sidewall.

6. The package and wiper blade combination of claim 4 wherein each channel segment sidewall has a plurality of spaced apart end-cap engaging fingers each having a generally V-shaped or generally U-shaped cross section.

7. The package and wiper blade combination of claim 6 wherein each end-cap engaging finger comprises an inclined guide surface facing generally outwardly toward the cover and an inclined abutment surface facing generally outwardly toward the channel segment end wall that abuts against part of the end cap when the wiper blade is received in the channel.

8. The package and wiper blade combination of claim 6 wherein each blade-arm receiving channel segment has a plurality of opposed end-cap engaging fingers spaced apart to engage a corresponding end cap when the wiper blade is received in the cavity with spring-back of the beam blade urging the adapter against the adapter receiving seat releasably capturing the wiper blade in the cavity.

9. The package and wiper blade combination of claim 1 wherein the cover comprises an outer wall spaced from the wiping element such that no part of the wiping element contacts the cover.

10. The package and wiper blade combination of claim 9 wherein the wiping element extends outwardly from the blade-retaining package panel such that no part of the wiping element contacts the blade-retaining package panel.

11. The package and wiper blade combination of claim 1 wherein the blade-holding cavity comprises a wiper blade adapter receiving seat and a pair of channels extending oppositely outwardly from the wiper blade adapter receiving seat with each channel comprising a wiper blade arm engagement region that provides a snap fit between a corresponding arm of the wiper blade.

12. The package and wiper blade combination of claim 11 wherein each wiper blade retention region comprises a plurality of opposed retention fingers.

13. The package and wiper blade combination of claim 12 wherein the wiper blade comprises a pre-curved beam type wiper blade and wherein the retention fingers of each wiper blade engagement region engages a corresponding end cap of a blade arm of a wiper blade received in the package cavity.

14. The package and wiper blade combination of claim 1 wherein the wiping element of the wiper blade extends outwardly beyond an outer wall of the blade-holding cavity.

15. The package and wiper blade combination of claim 1 wherein the wiper blade comprises a pre-curved beam type wiper blade.

* * * * *